United States Patent [19]

Polley

[11] 4,219,047

[45] Aug. 26, 1980

[54] TELESCOPING EDUCTION PIPE ASSEMBLY WITH ELASTOMERIC BOOT

[75] Inventor: Richard B. Polley, St. Charles, Mo.

[73] Assignee: ACF Industries, Incorporated, New York, N.Y.

[21] Appl. No.: 905,242

[22] Filed: May 12, 1978

[51] Int. Cl.[3] ..... B61D 5/00

[52] U.S. Cl. ..... 137/590; 137/125; 137/350

[58] Field of Search ..... 137/140, 590, 592, 577, 137/578, 125, 347, 350, 580; 220/85 S; 285/299, 300, 301; 222/398, 464; 277/212 FB

[56] References Cited

U.S. PATENT DOCUMENTS

| | | | |
|---|---|---|---|
| 1,748,185 | 2/1930 | Nichols et al. | 220/85 S |
| 1,868,799 | 7/1932 | Kramer | 220/85 S |
| 1,894,655 | 1/1933 | Auchincloss | 137/590 |
| 2,174,354 | 9/1939 | Shields | 137/590 X |
| 2,223,480 | 12/1940 | Darling | 285/299 X |
| 3,688,523 | 9/1972 | Schafer | 277/212 FB |
| 4,114,783 | 9/1978 | Wempe et al. | 222/398 |

FOREIGN PATENT DOCUMENTS

| | | | |
|---|---|---|---|
| 1212372 | 3/1966 | Fed. Rep. of Germany | 277/212 FB |

*Primary Examiner*—William R. Cline
*Attorney, Agent, or Firm*—Henry W. Cummings

[57] ABSTRACT

An eduction pipe and sump arrangement which does not require a skid includes an eduction pipe extending down from the top of the car and terminating a sufficient distance above the tank bottom to accommodate tank flexure. A sump is formed in the tank bottom directly below the eduction pipe. The sump is contoured such that there is no sump projection below the tank bottom in excess of one inch (1"). A guide pipe is attached to the interior of the tank bottom over the sump. The eduction pipe extends within the guide pipe. A ring is welded inside the guide pipe to provide centering for the eduction pipe and a load path for longitudinal and lateral forces induced by lading surging, and inertia of the eduction pipe. An elastomeric boot seal assembly including an elastomeric boot has one end attached to the eduction pipe and the other end attached to the guide pipe by hose clamps or other appropriate fasteners to seal the eduction pipe with respect to the interior of the tank. The eduction pipe is spaced inwardly from the inner wall of the guide pipe sufficiently that the elastomeric boot cannot be pinched or otherwise damaged by the telescoping action of the pipes. The sump slot formed in the tank bottom may be elongated, and the guide pipe may straddle the slot in one direction. In the other direction the slot may be longer than the guide pipe. Thus a channel for flow of commodity is created at each end of the slot sump. Preferably the slot is elongated longitudinally of the tank.

6 Claims, 7 Drawing Figures

TELESCOPING EDUCTION PIPE ASSEMBLY WITH ELASTOMERIC BOOT

BACKGROUND OF THE INVENTION

Siphon or eduction pipes are used on railway tank cars for loading and unloading through a valve on top of the car. The siphon or eduction pipe extends downward from the top unloading valve to the vicinity of the bottom of the tank.

It is desirable to locate the lower end of the eduction pipe as close as practically possible to the actual tank bottom. If the pipe terminates a given distance above the tank bottom, commodity will be left in the bottom of the car when it is unloaded, to the extent of the given distance.

As was discussed in application Ser. No. 827,129 filed Aug. 24, 1977, now U.S. Pat. No. 4,114,783, assigned to the same assignee as the present application, forces resulting from loading and unloading the lading, train action, and coupler impacts, cause the tank shell to flex in service. As a result the vertical diameter of the tank shell is not constant. Thus it is necessary to provide adequate clearance between the end of the eduction pipe and the bottom of the sump to accommodate this flexing.

The current state of the art is to provide a deep bowl sump in the tank bottom and extend the eduction pipe to a level approximately equal to the tank bottom. Recently enacted Association of American Railroads (AAR) and Department of Transportation (DOT) Regulations require that all fittings (such as sumps) extending more than one inch (1") below the shell envelope be provided with a suitable protective skid. This is an expensive and heavy device.

In application Ser. No. 827,129 a low profile sump and telescoping eduction pipe arrangement is disclosed including a lower fixed eduction pipe portion which extends into the lower portion of the sump, and an upper movable eduction pipe portion which telescopicly engages the lower eduction pipe portion for a distance at least equal to the distance that the tank top moves downwardly relative to the tank bottom when the car is impacted. Preferably the movable upper eduction pipe telescopes within the fixed, lower eduction pipe. This arrangement permits the use of a sump which fits within one inch of the shell envelope and therefore obviates the need for a protective skid. However, this arrangement requires the use of machined surfaces on the fixed and movable pipe portions and also requires sliding seals and wear rings. Formation of these machined surfaces and purchasing the seals and wear rings make this arrangement more expensive than desired.

SUMMARY OF THE INVENTION

The object of the present invention is to provide an eduction pipe and sump arrangement which does not require a skid to comply with AAR and DOT Regulations, and which is less expensive and simpler to assemble than the arrangement disclosed in application Ser. No. 827,129.

An eduction pipe extends down from the top of the car and terminates a sufficient distance above the tank bottom to accommodate tank flexure. A slot is cut in the tank bottom directly below the eduction pipe. A plate is welded to the exterior of the tank covering the slot. This produces a shallow sump which remains within the permissable one inch projection from the shell envelope. A guide pipe is attached to the interior of the tank bottom over the sump. The eduction pipe is of a diameter considerably less than the guide pipe. A ring is located inside the guide pipe to provide centering for the eduction pipe and a load path for forces induced by lading surging and inertia of the eduction pipe.

An elastomeric boot seal assembly including a boot made of elastomeric material has one end attached to the eduction pipe and the other end attached to the guide pipe. The boot is secured at both ends by hose clamps or other appropriate fasteners.

The space between the walls of the guide pipe and the eduction pipe is preferably sufficiently great that the elastomeric boot cannot be pinched or otherwise damaged by the action of the telescoping pipes.

Preferably the sump slot formed in the tank bottom is elongated and the guide pipe straddles the slot sump in the one direction. In the other direction the slot sump is longer than the guide pipe diameter. Thus a channel for flow of commodity is created at each end of the slot sump. Preferably the sump slot is elongated longitudinally of the tank.

However, other low profile sump arrangements may also be utilized, such as the bottom plate disclosed in application Ser. No. 827,129.

THE DRAWINGS

DESCRIPTION OF PREFERRED EMBODIMENTS

Figure 1:
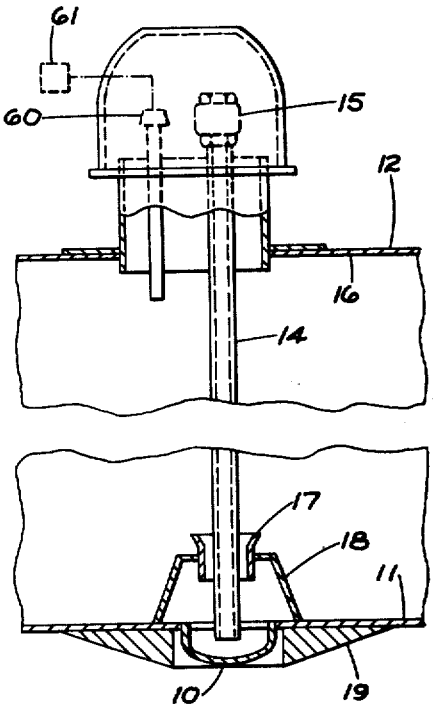
Prior Art Fig. 1
FIG. 1 is a schematic sectional view of a sump and eduction pipe arrangement of the prior art.

In the usual eduction pipe-sump arrangement a sump 10 is provided in the bottom 11 of a railway tank car 12. An eduction pipe 14 having an outlet valve 15 extends from the top of the car 16 downwardly into the sump 10. A guide 17 having a support 18 is provided to facilitate the relative movement of the tank top 16 and eduction pipe 14, and the tank bottom 11 and sump 12 when the tank car is impacted. For large tank cars to accommodate this relative movement, the sump must be sufficiently deep that it extends below the outside of the tank bottom more than one (1) inch, which according to AAR regulations requires a skid 19 to protect the sump in the event of impact to the sump or derailment. The skid adds weight to the car and added cost for labor and material.

In application Ser. No. 827,129 filed Aug. 24, 1977, hereby incorporated into the present application by this reference, to avoid the requirement for a skid, the eduction pipe and sump assembly 20 is provided including a low profile sump 22 (FIG. 2) which extends only a short distance below the tank bottom 24. In order to comply with current AAR regulations, the sump should not extend further down than one (1) inch. Sump 22 includes a flange portion 26 which is welded to tank bottom 24. A hollow sump portion 28 may extend below the tank bottom 24.

An eduction pipe indicated generally at 30 includes a lower fixed eduction pipe 32 which extends into hollow sump portion 28 and is suitably supported on the tank bottom 24, for example, by a formed plate 34 including legs 36 welded to a plate 35 which is welded to the tank bottom, and a generally horizontal portion 37 having a generally central opening 38. Fixed eduction pipe 32 extends through opening 38 and is welded to horizontal portion 37.

A movable eduction pipe indicated generally at 40 includes a lower portion 42 which extends within fixed eduction pipe 32, and an upper movable eduction pipe portion 44 which extends through the top of the car 16 and is provided with a valve 46.

Means for sealing the movable eduction pipe with respect to the fixed eduction pipe is indicated generally at 50 and includes a lip seal 52 (FIG. 4) mounted within a groove 53 within a fixed eduction portion 32. Lip seal 52 includes a lip portion 54 of elastomeric material adapted to sealingly engage movable eduction portion 42, and ring 56 which urges lip seal 52 into engagement with movable eduction pipe portion 42. Wear rings 57 and 58 are provided in respective grooves **57*a* and 58*a***. The seal prevents air leakage into the eduction pipe during the last stages of unloading. This leakage could result in pressure equalization which would render the eduction pipe inoperative if flow was interrupted after the liquid level was below the end of the upper movable eduction pipe.

Means 59 are provided to provide a pressure differential between valve means 46 and the sump 28. An air inlet valve 60 of conventional construction is provided to apply pressure from a pressure source 61 through a conduit **61*a* to the lading to force the lading up through fixed eduction pipe 32 and through movable eduction pipe 40. Alternatively a conventional pump 62 may be connected to outlet valve 46 through a conduit 63. Sealing means 50 ensures that a pressure differential is maintained between sump 22 and valve means 46 for successful unloading, particularly when the lading level is below the lower end of movable eduction pipe portion 42. An unloading hose or pipe 64 is attached to unloading valve 46 or to an unloading pump 62** to carry the lading to a receiving container (not shown).

When the car is impacted as during switching or over-the-rail operation, the tank top 16 and movable eduction pipe 40 move downwardly relative to the tank bottom 24. Movable eduction pipe portion 40 telescopes within fixed eduction pipe 32 to the extent that the tank top 16 moves downwardly relative to the tank bottom 24.

The low profile sump as constructed extends only a short distance below outside tank bottom 24, preferably not more than one (1) inch to meet current AAR regulations, so that a skid similar to skid 19 in FIG. 1 is not required. At the same time the tank top and movable eduction portion may move downwardly under impact without striking the bottom of the sump.

Figure 2:
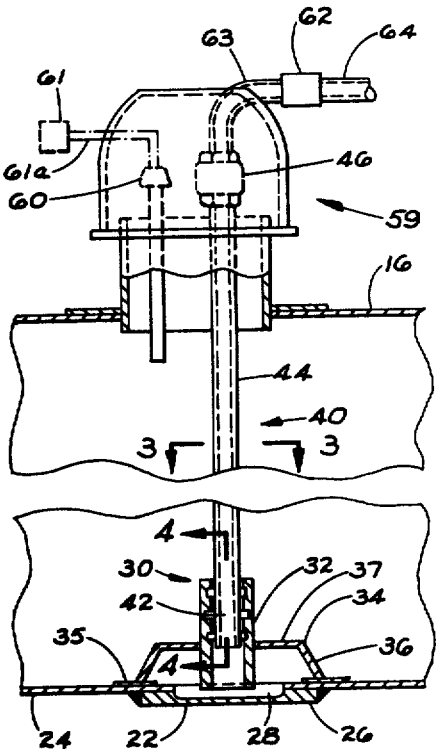
Prior Art Fig. 2
FIG. 2 is a schematic sectional view of the sump and eduction pipe arrangement according to application Ser. No. 827,129.
Figure 3:
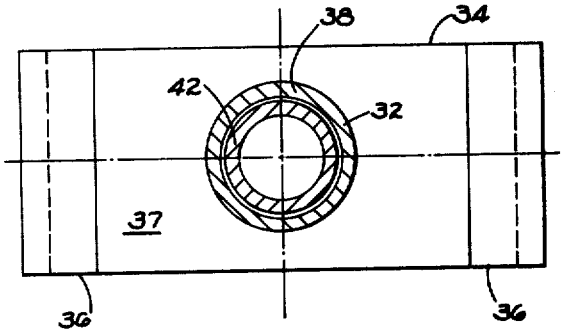
Prior Art Fig 3
FIG. 3 is a sectional plan view looking in the direction of the arrows along the line 3—3 in FIG. 2.
Figure 4:
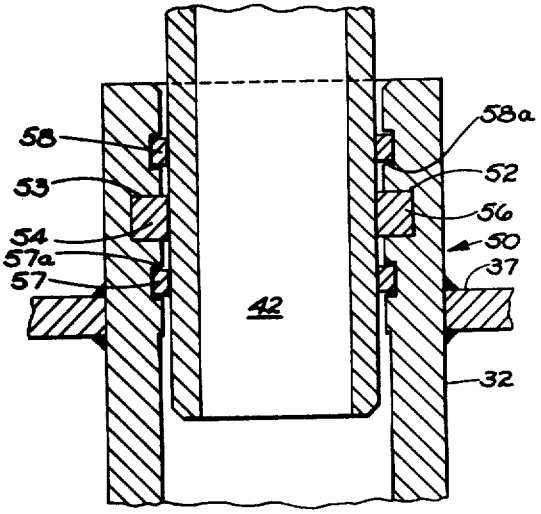
Prior Art Fig 4
FIG. 4 is a partial sectional view looking in the direction of the arrows along the line 4—4 in FIG. 2 illustrating a seal and wear rings between the fixed eduction portion and the movable eduction pipe portion.

The disadvantage of the arrangement shown in FIGS. 2–4 is that lower pipe portion 32 requires a machined surface for forming the slot wherein seal 52 and guides 57 and 58 are located. Furthermore a machined external surface may be required on upper pipe portion 42 which engages the seal and guides. The wear rings 57 and 58 and lip seal 52 are subject to wear and are likely to require occasional replacement.

In order to avoid the use of these machined surfaces and reduce maintenance costs, the arrangement of the present invention may be utilized. The sump arrangement of the present invention indicated generally at 100 in FIGS. 5–7 of the drawings includes a cylindrical guide pipe 102 which is welded to the tank bottom 104 with welds as shown at 105 and **105*a*. A ring or washer 106 is welded to the internal surface of the guide pipe as indicated at 108. Ring 106 includes a central opening 110**.

An eduction pipe 112 depends from the top of the tank 16. Eduction pipe 112 in general may be constructed along the lines of upper eduction pipe 44 described hereinabove. The eduction pipe 112 includes an upper portion 113 and a lower portion 114 of smaller diameter than the guide pipe 102 and the ring 106 and extends within guide pipe 102 and within ring 106. Clearance 116 exists between the lower portion 114 of the eduction pipe and ring 106. The clearance should be sufficient to allow relative vertical movement between eduction pipe 112 and ring 106. However, at the same time, the clearance should be small enough that lateral and longitudinal forces which normally would tend to move eduction pipe 112 longitudinally or laterally in the tank will cause the eduction pipe 112 to abut the ring 106.

The clearance between ring 106 and the lower portion 114 of eduction pipe 112 is preferably within the range of 1/16 inch to ¼ inch on each side.

The longitudinal and transverse loads applied to the eduction pipe will be transmitted to the ring and then down into the tank bottom through guide pipe 102.

Eduction pipe 114 is located above the tank bottom 104 a distance sufficient to allow the top of the tank to move downwardly relative to the tank bottom under impacts and avoid the eduction pipe 114 abutting the tank bottom or the sump. It has been found that this distance for many tank car applications is about three (3) inches.

In order to seal eduction pipe 112 with respect to the interior of the tank, an elastomeric boot seal assembly including an elastomeric member or boot 12 is attached to guide pipe 102 with a suitable fastening means indicated at 122, and further is connected to eduction pipe 112 with suitable fastening means indicated at 124. Fastening means 122 and 124 may conveniently comprise pipe clamps indicated at 126 and 128. However it is to be understood that other appropriate fastening means may be utilized so long as the elastomeric member 12 is sealingly attached to guide pipe 102 and to eduction pipe 112.

Elastomeric member or boot 12 must be made of flexible elastomeric material which is compatible with the ladings to be transported in the car. Furthermore the elastomeric member should be relatively rugged to withstand the back and forth movement of the telescoping pipes, and the longitudinal, lateral and vertical forces applied by the lading. While elastomeric member 12 must be able to flex and bend, it does not necessarily need to stretch. However, some stretching would not be deleterious. An example of a suitable material is Buna-N or ethylenepropylene, copolymers, both of which are commercially available. It will be apparent to those skilled in the art that many other materials would be satisfactory for use in this environment.

When the top of the tank moves downwardly relative to the bottom of the tank, elastomeric seal assembly 120 will move down with eduction pipe 112. The distance between guide pipe 102 and eduction pipe 112 must be such as to allow elastomeric member 120 to fold upon itself within guide pipe 102 and not bind between the guide pipe and the eduction pipe. As an example, it has been found that guide pipe 102 is conveniently constructed of five (5) inch pipe whereas at least the lower portion of eduction pipe 112 extending within guide pipe 102 is conveniently constructed of two (2) inch pipe. It will be apparent, however, that other size pipes may be utilized so long as binding of elastomeric member 120 within the guide pipe 102 is avoided. The pipe cross section need not be circular.

The ring 106 is located sufficiently below the top of guide pipe 102 so that when eduction pipe 112 moves downwardly relative to the tank bottom and elastomeric member 12 moves therewith, elastomeric member 12 will not reach ring 106. This is a further preventative feature to avoid elastomeric member 120 binding within guide pipe 102.

A sump 130 is formed in the bottom of the tank. If desired the sump may be formed as shown in FIG. 2 with the sump concentric with the guide pipe. With this low profile sump arrangement, no skid is required to comply with the AAR and DOT Regulations.

Figure 5:
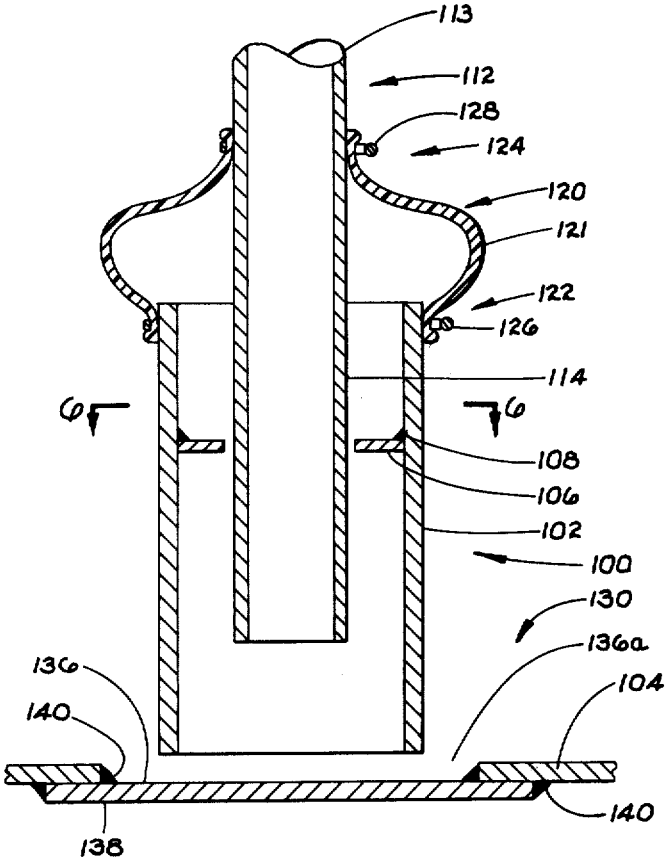
FIG. 5 is a partial longitudinal sectional view of a portion of the siphon and sump arrangement of the present invention looking in the direction of the arrows along the line 5—5 in FIG. 6.
Figure 6:
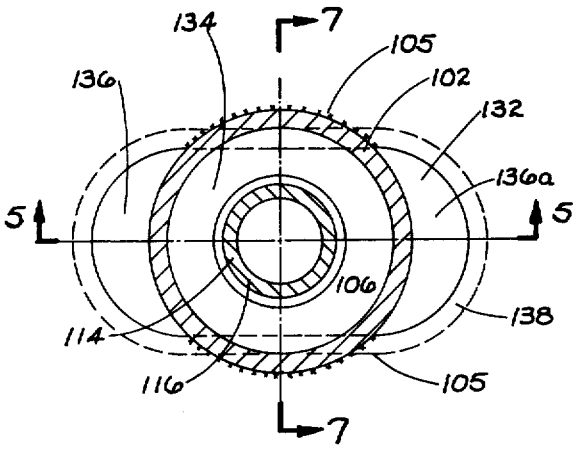
FIG. 6 is a sectional plan view looking in the direction of the arrows along the line 6—6 in FIG. 5.
Figure 7:
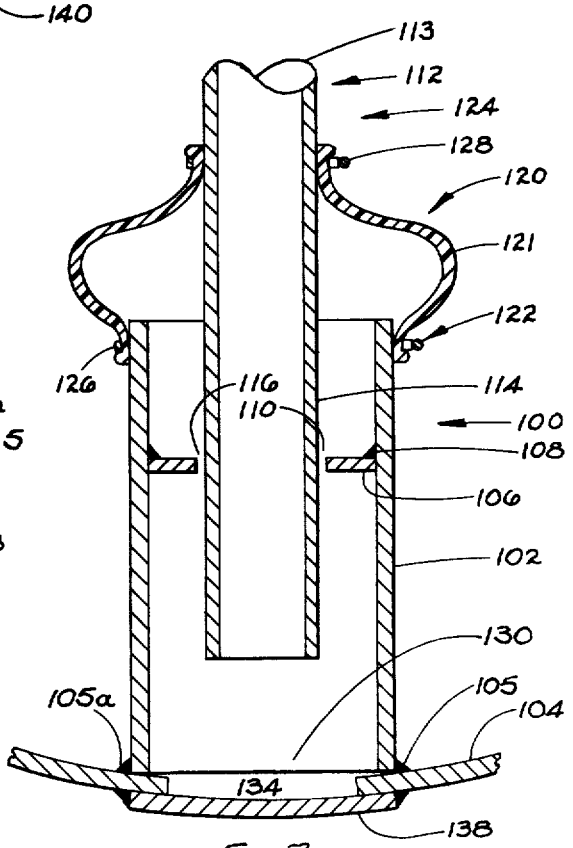
FIG. 7 is a partial transverse sectional view looking in the direction of the arrows along the line 7—7 in FIG. 6.

However, if desired, the sump arrangement shown in FIGS. 5–7 may be utilized. It will be seen that in FIG. 6 the guide pipe 102 is welded at opposite sides 105 and **105*a* of the tank bottom 104. A longitudinally extending slot 132 (FIG. 6) is formed in the tank bottom. It will be apparent that the center portion 134 of longitudinally extending slot 132 is located within the confines of guide pipe 102. However the end portions 136 and 136*a* of the slot 132 are located outboard of guide pipe 102**.

As shown in FIGS. 5 and 7 a plate 138 is welded to the tank bottom 104 as indicated at 140. With this arrangement the lading from either end of the car can readily flow longitudinally through channels 136 and **136*a* into the sump 132 and then upwardly through guide pipe 102 and then into eduction pipe 112. With this construction sump 132 can be formed to deliver sufficient lading flow without forming a depression in plate 138, in contrast to the sump shown in FIG. 2. Plate 138 can be constructed of material less than one (1) inch thick and thus a skid is not required to comply with the AAR and DOT Regulations concerning projections below the tank bottom. If desired the sump 132** can be elongated in the transverse direction instead of longitudinally as illustrated, but in most applications would not drain the tank as effectively.

In operation, differential pressure is applied either by pump 62 or air pressure applied through connection 61 to force the lading into sump 132 through channels 136 and **136*a*, then into guide pipe 102, then up through the eduction pipe 112 and out of the tank. Elastomeric boot seal assembly 120 maintains a seal between eduction pipe 112 and the interior of the tank so that nearly all of the liquid at the bottom of the tank can be unloaded with the sump and eduction pipe arrangement of the present invention. When the tank top moves downwardly relative to the tank bottom, for example under coupling impact or train action, the eduction pipe 112 moves downwardly relative to guide 102 and ring 106. However the distance between the eduction pipe and the tank bottom is such that the eduction pipe does not bottom out on the tank bottom or sump. Elastomeric boot 12 moves downwardly when lower eduction pipe portion 114 moves downwardly. However the spacing between eduction pipe portion 114 and guide pipe 102 and ring 106 is such that elastomeric member 12 does not become bound during downward or upward movement of eduction pipe 112. Lading loads applied to eduction pipe 112 cause pipe portion 114 to engage ring 106, and the load to be transferred into ring 106 and then down to the tank bottom through guide pipe 102**.

It is thus seen that a siphon and eduction pipe arrangement has been provided in accordance with the present invention which is easy to fabricate, does not require machined surfaces for the guide pipe or the eduction pipe, and in which the more expensive seals and wear rings disclosed in the sump and eduction pipe arrangement disclosed in Ser. No. 827,129 are not required. Maintenance cost will be less because of the elimination of consumable components (seal 52 and wear rings 57 and 58, FIG. 4).

Furthermore a low profile sump arrangement has been provided which does not require a depression formed in the tank bottom plate, and in which one or more channels for lading flow toward the eduction pipe are provided.

What is claimed is:

1. An eduction pipe and sump arrangement in a railway tank car comprising:

an eduction pipe extending down from the top of the tank and terminating a sufficient distance above the tank bottom to accommodate relative movement between the tank top and the tank bottom; a sump in the tank bottom below said eduction pipe; a guide pipe attached to the interior of the tank bottom and extending over at least a portion of said sump; said eduction pipe extending within said guide pipe; an elastomeric boot seal assembly embodying a boot made of elastomeric material having one end portion attached to said eduction pipe and the other end attached to said guide pipe; whereby to seal said eduction pipe with respect to said tank, and allow removal of lading from said tank by vacuum suction or positive pressure through said guide pipe and said eduction pipe; during telescoping of said eduction pipe within said guide pipe, said elastomeric boot also telescoping within said guide pipe; the distance between the inner wall of the guide pipe and the outer wall of the eduction pipe being sufficiently great that the elastomeric boot is not readily pinched, abraded or otherwise damaged by the telescoping action of the eduction pipe and boot within the guide pipe; eduction pipe centering means inside said guide pipe comprising a ring integral with the integral surface of said guide pipe to provide centering for the eduction pipe and a load path for lateral and longitudinal forces applied to said eduction pipe; said ring being located sufficiently far below said elastomeric boot whereby said elastomeric boot does not contact said ring during relative movement between said eduction pipe, boot and said guide pipe.

2. An eduction pipe and sump arrangement according to claim 1 wherein said guide pipe and said eduction pipe each have a circular cross section.

3. An eduction pipe and sump arrangement according to claim 2 wherein said sump comprises a slot extending through said tank bottom and a plate is welded to the exterior of the tank covering said slot, said plate not extending below the tank bottom in excess of (1) inch.

4. An eduction pipe and sump arrangement according to claim 3 wherein said sump is elongated and wherein the guide pipe straddles the sump in the one direction, and in the other longitudinal direction the sump extends beyond the guide pipe forming a channel for flow of commodity into the eduction pipe from at least one end of the sump.

5. An eduction pipe and sump arrangement according to claim 4 wherein said sump is elongated longitudinally of the tank bottom.

6. An eduction pipe and sump arrangement according to claim 3 wherein said plate includes a slot which in part defines said sump.

* * * * *